US006269597B1

(12) United States Patent
Haas

(10) Patent No.: US 6,269,597 B1
(45) Date of Patent: Aug. 7, 2001

(54) STORM PANEL SUPPORT APPARATUS FOR WINDOWS

(76) Inventor: John W. Haas, 11093 Harbour Springs Cir., Boca Raton, FL (US) 33429

( * ) Notice: Subject to any disclaimer, the term of this patent is extended or adjusted under 35 U.S.C. 154(b) by 0 days.

(21) Appl. No.: 09/266,563

(22) Filed: Mar. 11, 1999

(51) Int. Cl.[7] ..... E06B 3/30; E06B 3/28

(52) U.S. Cl. ..... 52/203; 52/208; 52/212; 52/204.54; 52/204.67; 52/204.71; 52/204.597; 52/476; 52/483.1; 49/57; 49/62; 49/464

(58) Field of Search ..... 52/204.1, 204.53, 52/204.54, 204.595, 204.597, 204.6, 204.68, 204.7, 204.71, 204.72, 211–213, 215, 214, 202, 203, 208, 204.67, 476, 204.62, 483.1; 49/57, 62, 464

(56) References Cited

U.S. PATENT DOCUMENTS

| | | | | |
|---|---|---|---|---|
| 3,745,704 | | 7/1973 | Covington . | |
| 4,333,271 | * | 6/1982 | DePaolo et al. | 49/464 |
| 4,454,691 | * | 6/1984 | Mitchell | 52/202 |
| 4,685,261 | * | 8/1987 | Seaquist | 52/202 |
| 5,003,738 | * | 4/1991 | Hogeland | 52/202 |
| 5,343,668 | | 9/1994 | Gonzalez . | |
| 5,430,982 | * | 7/1995 | Bane | 52/202 |
| 5,603,190 | * | 2/1997 | Sanford | 52/202 |
| 5,740,639 | * | 4/1998 | Covington | 52/202 |
| 5,768,833 | * | 6/1998 | Golen | 52/202 |
| 5,787,642 | * | 8/1998 | Coyle et al. | 49/61 |
| 5,855,099 | * | 1/1999 | Hoffman | 52/202 |
| 5,996,292 | * | 12/1999 | Hill et al. | 52/202 |

* cited by examiner

*Primary Examiner*—Yvonne M. Horton
(74) *Attorney, Agent, or Firm*—Alvin S. Blum

(57) ABSTRACT

A rectangular window opening in a structure is provided with four channel members that provide a decorative frame around the opening. Three of the channel members are permanently fastened to the structure through a flange on the channel. The fourth channel member is removably fastened in place. When the opening must be covered by a storm panel, the fourth channel is unfastened and removed. A rigid rectangular panel is mounted in the three channels. The fourth channel is then mounted on the fourth edge of the panel and then the fourth channel is removably fastened to the structure. All of the elements except the panel remain in place. The panels have no holes or accessories. All panels are interchangeable for the same size window. No tools are needed to mount or remove a panel.

14 Claims, 2 Drawing Sheets

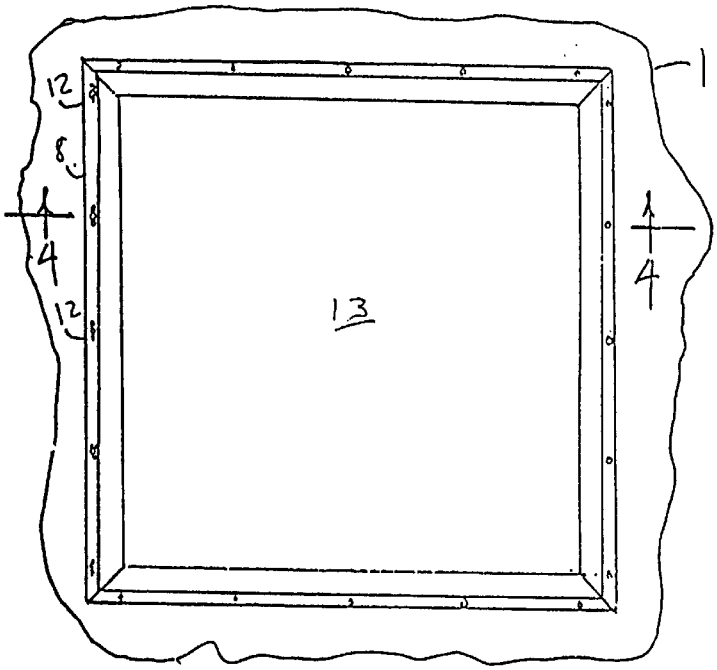
FIG. 3
FIG. 5
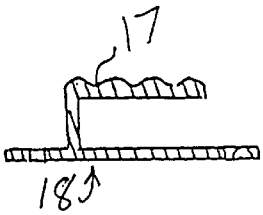
FIG. 6
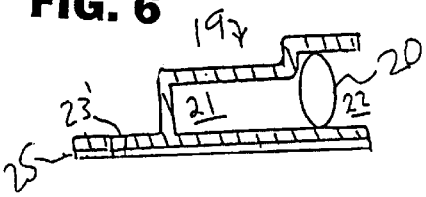
FIG. 7
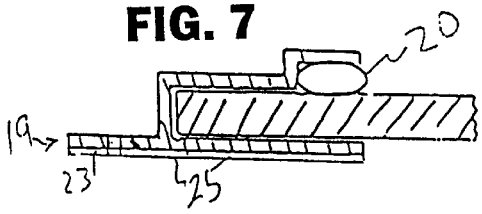
FIG.4
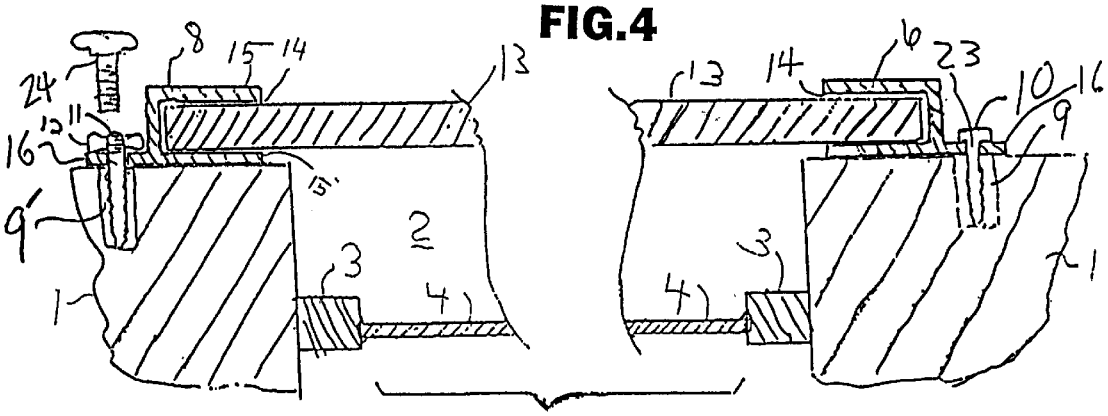

STORM PANEL SUPPORT APPARATUS FOR WINDOWS

BACKGROUND OF THE INVENTION

This invention relates to coverings of window openings for protection against storms, and, more particularly, to support elements for removably securing rigid panels over window openings to protect them against storms.

U.S. Pat. No. 5,603,190 issued Feb. 18, 1997 presents a review of the art and teaches a system in which channels for receiving and holding a rigid panel are affixed to three sides of a window opening. A fourth channel is affixed to the rigid panel. The panel is slid into the three channels and the fourth channel is then bolted to the fourth side of the window opening to secure the panel in place in preparation for a storm. After the storm threat has passed, the fourth side is unbolted and removed with the panel. This leaves the window with a permanent three-sided frame that is not particularly attractive. It requires that the bolts be stored with the panels. They can easily be misplaced in the years between use. Panels with channels or attachment members, not being planar, are not as easily stored as planar panels. Because the bolt openings in the panel channel must be in registry with bolt receiving holes in the building structure on one side of the window, each panel may only fit one particular window, making the process of protection more complex at a time when speed and simplicity may be desirable.

SUMMARY OF THE INVENTION

It is accordingly an object of the invention to provide means for removably holding a simple, plain rigid panel over a window opening that can be readily deployed with a minimum of effort and skill, and no tools. It is a further object that the means for securing a storm panel provide an attractive embellishment to the window opening when the panel is not in place. It is a further object to provide a system in which all window openings of the same size use panels that are interchangeable. It is yet another object that all of the elements of the support system other than the panels remain in place on the window opening structure between deployments to facilitate deployment and avoid misplacement of essential elements.

The support system of the invention comprises straight rigid elements that fasten permanently to three sides of the structure adjacent a rectangular window opening. Each element has a channel dimensioned to receive therein an edge of a rectangular rigid panel. A fourth element is removably fastened to a fourth side of the structure adjacent the window opening. It also has a similar channel. The four elements remain in place around the window providing a decorative frame when panels are not in use.

When it is necessary to deploy the panel, the fourth element is removed from the structure, the panel slid into place with three edges of the panel in the three channels. Then the fourth element is set in place, with its channel engaging the fourth edge of the rectangular panel. The fourth element is then removably affixed to the structure. To provide a simple effective removable attachment of the fourth element to the structure, threaded studs may be permanently affixed to the structure with the threaded ends extending outward. A wing nut may be threaded onto the stud to secure the fourth element to the structure without tools.

These and other objects, features and advantages of the invention will become more apparent when the detailed description is studied in conjunction with the drawings, in which like reference characters indicate like elements in the various drawing figures.

BRIEF DESCRIPTION OF THE DRAWINGS

FIG. 3 is a view as in FIG. 1 with the panel in place and the removable side channel restored to position.

FIG. 4 is a sectional view taken through line 4—4 of FIG. 3, partially broken away.

FIG. 5 is a sectional view of another channel member of the invention.

FIG. 6 is a sectional view of another channel member of the invention with a resilient sealing strip.

FIG. 7 is a sectional view of the channel member of FIG. 6 with a panel in place.

DETAILED DESCRIPTION OF PREFERRED EMBODIMENTS

Figure 1:
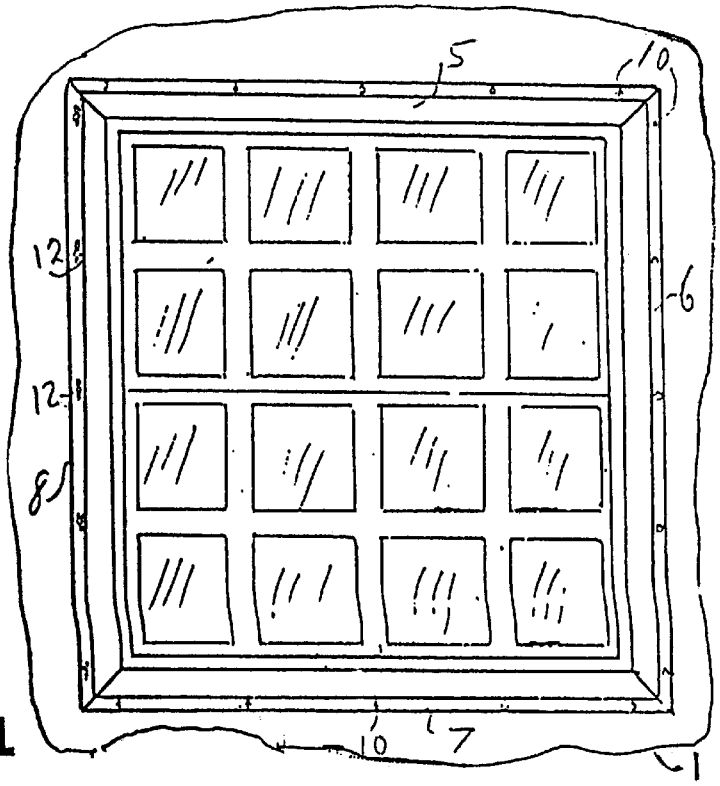
FIG. 1 is a front elevation view of a window opening in a structure with panel support apparatus of the invention in place.

Referring now first to FIGS. 1–4, a building structure 1 has a rectangular window opening 2. Surrounding the window opening are four channel members 5, 6, 7, 8 that are fastened to the structure and that provide a decorative element when the window is not covered by a panel for protection in anticipation of a storm. The channels may be made of a metal such as aluminum or galvanized steel. Alternatively, they may be extruded of a plastic material that may be painted to match or contrast with the structure paint. Channels 5, 6, and 7 are permanently fastened to the structure, such as with hex head lag screws 10 that may be screwed directly into a wood structure, (not shown) or with cement or screw anchors 9 in a masonry structure through fastener receiving apertures 23. These apertures are provided at intervals in a flange 16 that lies flat against the structure and extends away from the panel receiving opening 14 formed by the two spaced apart legs 15 of equal length. The opening is dimensioned to receive the straight edges of a rigid rectangular panel 13 such as, for example, ¾ inch plywood or corrugated fiberglass-loaded plastic. These panels are inexpensive, readily available, and they may be easily stored when not in use because they are planar, without any attachments. All window openings of the same size can use the panels interchangeably. There are no holes to match in the panels. The fourth channel 8 is removably mounted to the structure with threaded fasteners. An anchor 9' permanently set in the structure has female threads to receive therein a removable thumbscrew 24 that may be inserted or removed without tools. Alternatively, a threaded stud 11 is permanently fixed to the structure with male threads extending outward to cooperate with wing nuts 12 that may be operated without tools.

Figure 2:
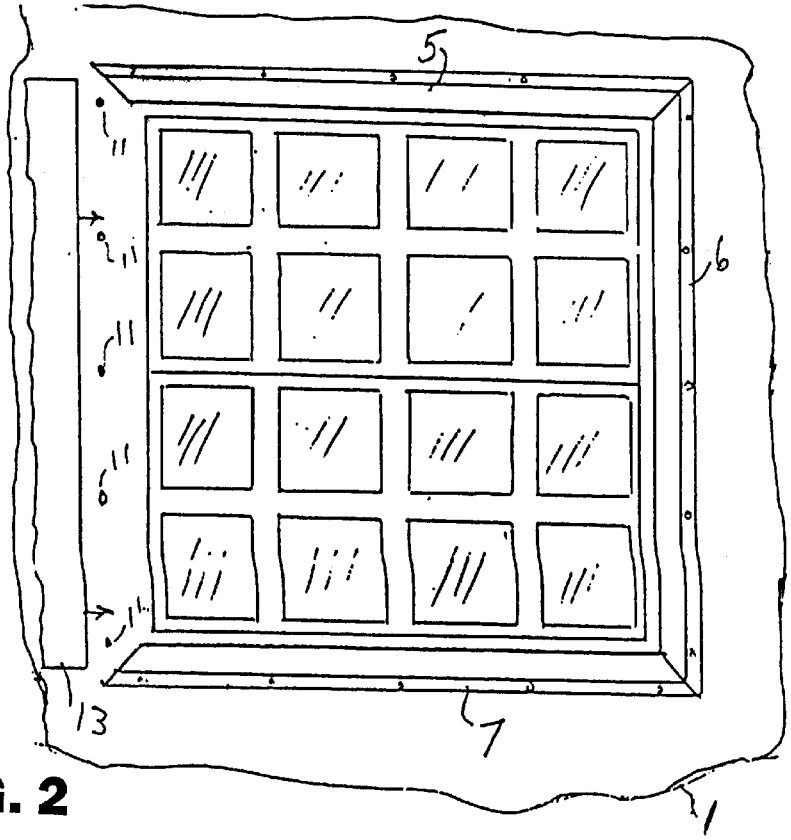
FIG. 2 is a view as in FIG. 1 with one side channel member removed and panel (partially broken away) ready to slip into the remaining three channel members.

The method of operation of the invention is as follows:

As shown in FIG. 1, channels 5,6,7 are permanently mounted on the structure with wing nuts 10, and channel 8 is removably mounted with fasteners 12 to provide a decorative frame for the window opening. Flat rectangular panels are stored. When the window opening needs to be covered, wing nuts 12 are removed and channel 8 removed. As shown in FIG. 2, a panel 13 is slid into the openings in the channels 5,6, and 7. As shown in FIG. 3, channel 8 is positioned on the fourth edge of the panel 13 with fasteners fitting into the apertures in the flange, then wingnuts 12 are screwed on. Alternatively thumbscrews 24 (FIG. 4) may be employed. Storm forces on the panel 13 are transmitted through the channels to the Structure 1. The panel is spaced away from the window frame 3 and the glass 4 so that some flexing of the panel will not break the glass. The outer surface of the channels may be provided with longitudinal decorative elements or striations 17 as shown in the alternative embodiment 18 in FIG. 5 in which the legs of the channel are unequal.

In the alternative embodiment shown in FIGS. 6,7 a resilient gasket 25 is cemented to the surface of the channel 19 that will be against the structure. The channel opening is narrower at the inner aspect 21 being dimensioned to hold the panel edge securely and wider at the outer aspect 22 of the opening so as to receive a resilient sealing strip 20 that may be a solid foam elastomer or a tubular shape of various configurations, for example. When the panel is not in place, the sealing strip 20 prevents foreign debris from accumulating in the opening. When the panel is in place, the strip 20 seals the panel to the channel while gasket 25 seals the channel against the structure. This embodiment more effectively seals the window opening.

The above disclosed invention has a number of particular features which should preferably be employed in combination, although each is useful separately without departure from the scope of the invention. While I have shown and described the preferred embodiments of my invention, it will be understood that the invention may be embodied otherwise than herein specifically illustrated or described, and that certain changes in the form and arrangement of parts and the specific manner of practicing the invention may be made within the underlying idea or principles of the invention.

What is claimed is:

1. A storm panel attachment apparatus for mounting a rigid rectangular storm panel that has four edges over a rectangular window opening in a structure supporting a window, the window having an upper part, a lower part, and two sides, the attachment apparatus comprising:

a rigid, straight, downwardly opening first channel means for fixedly mounting horizontally on the structure adjacent to the upper part of the window;

a rigid, straight, upwardly opening second channel means for fixedly mounting horizontally on the structure adjacent the lower part of the window;

a rigid, straight, laterally opening third channel means for fixedly mounting vertically on the structure adjacent one of the two sides of the window with the opening of the third channel means facing the window;

a rigid, straight, laterally opening fourth channel means for removably mounting vertically on the structure adjacent the other of the two sides of the window with the opening of the fourth channel means facing the window;

the first, second, third, and fourth channel means having openings dimensioned for receiving therein the rigid rectangular panel and disposed about the opening to provide a substantially continuous rectangular holding frame for the edges of the panel wherein fasteners are not required for attachment between the panel and the channel means;

the fourth channel means being removable so as to enable the insertion of three edges of the rigid rectangular panel into the first, second, and third channel means, and then enable sliding the fourth edge of the panel into the opening in the fourth channel means and removably fastening the fourth channel means to the structure to thereby lock the panel in place over the window opening; and the fourth channel means for mounting on the structure to provide an enhanced complete decorative frame for the window opening during the great majority of the time when the panel is not in use.

2. The apparatus according to claim 1 further comprising:

fastening means for removably fastening the fourth channel means to the structure wherein the fourth channel means remains in position when the panel is not in use to prevent loss or misplacement thereof between panel applications.

3. The apparatus according to claim 2 in which the first, second, third and fourth channel means are provided with a flange extending away from the opening, the flange provided with fastener receiving apertures by which the channel means are adapted to be fastened to the structure.

4. The apparatus according to claim 3 in which each of said channel means is constructed with legs on each side of the opening being of equal length.

5. The apparatus according to claim 3 in which each of said channel means is constructed with legs on each side of the opening being of unequal length.

6. The apparatus according to claim 3 further comprising a resilient sealing strip means, and in which the opening in each of said channel means is narrower at an inner aspect thereof to receive therein the panel and wider at an outer aspect thereof to receive therein the resilient sealing strip means for sealing the panel against a leg of the channel means and for storing the sealing strip means when a panel is not in use, while sealing the opening against foreign debris.

7. The apparatus according to claim 6 in which an outer surface of said channel means is provided with longitudinal striations for decorative purposes.

8. The apparatus according to claim 1 in which an outer surface of said channel means is provided with longitudinal striations for decorative purposes.

9. The apparatus according to claim 1 further comprising a resilient strip means, and in which the opening in each said channel means is narrower at an inner aspect thereof to receive therein the edge of the panel and wider at an outer aspect thereof to receive therein a resilient sealing strip means for sealing a leg of the channel means against the panel and for storing the sealing strip means therein when a panel is not in use, while sealing the opening against foreign debris.

10. The apparatus according to claim 9 further comprising a resilient gasket means fastened to a surface of the channel means wherein the resilient gasket is adapated to contact the structure for sealing the channel means to the structure.

11. The apparatus according to claim 6 further comprising a resilient gasket means fastened to a surface of the channel means wherein the resilient gasket is adapated to contact the structure for sealing the channel means to the structure.

12. A method of providing a decorative frame for a window opening having four sides in a structure and removably covering the window opening with a rigid rectangular panel having four edges, the method comprising:

providing four rigid straight channel members, each channel member having a channel opening dimensioned for receiving therein an edge of the panel and a mounting flange extending away from the channel opening, the flange having fastener receiving apertures;

permanently fastening three of the channel members to the structure adjacent three of the sides of the window opening and removably fastening a fourth channel member to the fourth side of the window opening with fasteners through the receiving apertures in the flanges to provide a decorative frame with all fastening elements in place when the panel is not in use;

removing the fourth channel member;

sliding the panel into the three other channel members;

sliding the fourth channel member onto the panel; and refastening the fourth channel member to the structure to securely hold the panel in place without requiring fasteners from the channel members into the panel.

13. The method according to claim 12 further comprising:

providing a resilient sealing strip;

providing channel members that have an enlarged entrance aspect of the channel opening for receiving and storing the sealing strip to prevent entrance of debris;

removing the sealing strip prior to insertion of the panel;

forcing the sealing strip sealingly between the panel and the channel member after the panel and the fourth channel member have been installed.

14. The method according to claim 13 further comprising:

providing a resilient sealing gasket on a surface of the channel member such that the resilient sealing gasket is adapted to contact the structure.

* * * * *